US007403366B2

(12) United States Patent
Melchert et al.

(10) Patent No.: US 7,403,366 B2
(45) Date of Patent: Jul. 22, 2008

(54) CONTROL CIRCUIT FOR AN ELECTROMAGNETIC DRIVE

(75) Inventors: Wilhelm Melchert, Hennef-Rott (DE); Gerd Schmitz, Troisdorf (DE)

(73) Assignee: Moeller GmbH, Bonn (DE)

( * ) Notice: Subject to any disclaimer, the term of this patent is extended or adjusted under 35 U.S.C. 154(b) by 240 days.

(21) Appl. No.: 10/523,087

(22) PCT Filed: Jul. 26, 2003

(86) PCT No.: PCT/EP03/08281

§ 371 (c)(1),
(2), (4) Date: Feb. 2, 2005

(87) PCT Pub. No.: WO2004/015733

PCT Pub. Date: Feb. 19, 2004

(65) Prior Publication Data

US 2005/0254270 A1 Nov. 17, 2005

(30) Foreign Application Priority Data

Aug. 2, 2002 (DE) ..... 102 35 297

(51) Int. Cl.
*H01H 47/00* (2006.01)
*H01H 9/00* (2006.01)

(52) U.S. Cl. ..... 361/139; 361/152; 361/154

(58) Field of Classification Search ..... 361/139, 361/152, 154
See application file for complete search history.

(56) References Cited

U.S. PATENT DOCUMENTS

| | | | | |
|---|---|---|---|---|
| 4,178,619 | A * | 12/1979 | Seiler et al. | 361/91.6 |
| 4,633,362 | A * | 12/1986 | Saunders | 361/152 |
| 5,422,780 | A | 6/1995 | Lignar | 361/154 |

FOREIGN PATENT DOCUMENTS

| | | |
|---|---|---|
| DE | 39 20 279 | 1/1991 |
| DE | 92 16 041 U1 | 2/1993 |
| DE | 44 10 819 | 9/1994 |
| DE | 196 38 260 | 11/1997 |
| DE | 299 09 901 U1 | 11/1999 |
| EP | 0 009 106 | 4/1980 |
| EP | 0 091 648 | 10/1983 |
| EP | 0 840 342 | 7/2002 |
| FR | 2 808 619 | 5/2001 |

OTHER PUBLICATIONS

Berlin, 555 Timer Applications Sourcebook With Experiments, 1976, Howard W. Sams & Co, Inc. pp. 7-19.*

* cited by examiner

*Primary Examiner*—Michael J Sherry
*Assistant Examiner*—Zeev Kitov
(74) *Attorney, Agent, or Firm*—Darby & Darby

(57) ABSTRACT

A control circuit for an electromagnetic drive includes first and second electronic switching elements, which in conjunction with a timing element subject the drive coil to a corresponding direct current in the starting phase or in the maintenance phase. A starting current and a maintenance current are provided by means of a current source that is controlled by the timing element and a direct current converter with downward control.

14 Claims, 2 Drawing Sheets

CONTROL CIRCUIT FOR AN ELECTROMAGNETIC DRIVE

The present invention relates to a control circuit for an electromagnetic operating mechanism, in particular, the operating mechanism of an electromagnetic switching device. The electromagnetic operating mechanism generally includes an operating coil, a magnetic core, and an armature.

BACKGROUND

An electronic drive control for a contactor operating mechanism is described in German Publication DE 299 09 901 U1. The drive control essentially includes a rectifier circuit supplied via control inputs, a series circuit which is composed of the operating coil and a pulse-width controlled transistor switch and is supplied by the rectifier circuit, two voltage divider circuits which scan the output of the rectifier circuit and are isolated on the input side by an isolation diode, as well as an electronic circuit including a microprocessor and two memories. Control signals for the pickup and holding modes of the operating coil are supplied to the transistor by the electronic circuit; the corresponding pulse widths in the pickup and holding modes being determined via the associated memory in accordance with the output signal of the associated voltage divider. Moreover, it is known from German Publication DE 299 09 904 U1 to provide such electronic drive controls with a first transistor switch for controlling the pickup current and a second transistor switch for controlling the holding current. Such electronic drive controls have the disadvantage of having a high degree of complexity, which is due to the electronic circuit and is of particular consequence for operating mechanisms of lower-rated electromagnetic switching devices.

German Publication DE 92 16 041 U1 describes a circuit arrangement for controlling a relay. The series circuit of the operating coil and the first transistor switch is connected to a DC operating voltage, and the series circuit of a holding resistor and a second transistor switch is placed in parallel with the switching path of the first transistor switch. A d.c. control input is connected, via a differentiating timer including a capacitor and a discharge resistor, to the control electrode of the first transistor switch and, via a series resistor, to the control electrode of the second transistor switch. After a control voltage has been applied, both the first and second transistor switches are turned on, as a result of which a pickup voltage is applied across the operating coil; the pickup voltage obtained being the DC operating voltage minus the saturation voltage of the first transistor switch. When the capacitor voltage of the differentiating element has dropped, the first transistor goes to the OFF state. Consequently, the operating coil is then only supplied with a holding current, which is essentially obtained from the ratio of the DC operating voltage to the sum of the holding resistance and the ohmic resistance of the operating coil. After the control voltage has been removed, the second transistor switch is also turned off, thereby switching off the relay. In the case of this control circuit, both the pickup response and the reliability and heat losses in the holding mode are highly dependent on changes and fluctuations in the DC operating voltage. The drive control, which is only suitable for DC voltage operation, uses a control voltage in addition to the operating voltage; the control voltage being independent of the operating voltage. An additional significant amount of power is lost through the holding resistor.

German Patent DE 44 10 819 C2 discloses a circuit arrangement which is intended to operate a relay and which, in turn, has a first transistor switch, which is turned on during the pickup phase, and a second transistor switch, which is placed in series with the operating coil and a holding resistor and connected to an operation voltage and which is turned on when the relay is in the ON state. The switching path of the first transistor switch is placed in parallel with the holding resistor. A d.c. control input is connected via a voltage divider to the control electrode of the second transistor switch. The control electrode of the first transistor switch is connected to the junction point of the first transistor switch, the second transistor switch and the holding resistor via an integrating timer including a charging resistor and a capacitor. When the relay is in the OFF state, the capacitor is charged via the operating coil, the holding resistor and the charging resistor so that both transistor switches are turned on when a control voltage is applied. In this connection, the pickup voltage obtained for the operating coil equals the operating voltage minus the sum of the saturation voltages of the two transistor switches. At the same time, the capacitor begins to discharge through the series resistor and the switching path of the second transistor switch. After the capacitor voltage has fallen below a threshold value, the first transistor is turned off. Consequently, the operating coil is then only supplied with a holding current, which is essentially obtained from the ratio of the DC operating voltage to the sum of the holding resistance and the ohmic resistance of the operating coil. After the control voltage has been removed, the second transistor switch is also turned off, thereby switching off the relay. This drive control presents the above-described disadvantages of the approach of German Publication DE 92 16 041 U1 and requires an operating voltage to be provided continuously or at least with sufficient time before the relay is switched on.

German Patent 196 38 260 C2 discloses a circuit arrangement for controlling small solenoid coils, including a transistor switch connected in series with the solenoid coil. Upon application of a control voltage, the turned-on transistor switch applies a high pickup current to the solenoid coil during a time period set by a differentiating timer. After that, the holding current is determined by a series circuit which is composed of a holding resistor and a light-emitting diode and is placed in parallel with the switching path of the transistor switch. Here too, the pickup and holding currents are highly dependent on the magnitude of the control voltage, and a significant amount of power is lost through the holding resistor.

SUMMARY OF THE INVENTION

It is therefore the an object of the present invention to provide a low-power control circuit that has a low degree of complexity and is largely independent of voltage.

The present invention provides a control circuit for an electromagnetic operating mechanism, wherein a pickup voltage and a holding voltage, which is significantly lower than the pickup voltage, are provided by relatively simple means in the form of a timer-controlled voltage source and a step-down d.c. voltage converter. The magnitude of the pickup voltage is below the permissible operating voltage range and is largely independent of the magnitude of the control voltage. The holding voltage is controlled to a level which, in terms of absolute value, is far below the pickup voltage. The voltage applied to the control input, which can be selected to be a DC voltage or an AC voltage, at the same time powers the control circuit. After the control voltage has been applied, the operating voltage is built up immediately via the rectifier circuit. The developing operating voltage, first of all, activates a timer and builds up the holding voltage via the d.c.

voltage converter. The operating coil is energized by the activated voltage source via the first switching means, while the switching path of the second switching means, which is placed in series with the operating coil, is enabled concurrently. An isolation diode prevents the pickup voltage from reaching the output of the d.c. voltage converter. After a certain time has elapsed, that is, after the pickup time has elapsed, the timer deactivates the voltage source and thereby also the first switching means. Power supply to the operating coil as well as the maintained ON state of the second switching means are then provided by the d.c. voltage converter with the holding voltage supplied via the isolation diode. After the control voltage has been removed, the operating voltage and the holding voltage break down, whereupon the second switching means are turned off, as a result of which the operating coil is de-energized. The time behavior of the timer and the pickup voltage must be selected such that the armature activated by the operating coil is reliably attracted by the magnetic core. During the holding phase, the voltage across the operating coil is significantly lower than during the pickup phase. The holding voltage must be selected, by adjusting the d.c. voltage converter, to a level just sufficient to reliably hold the armature in its attracted position.

The proposed control circuit does not need any complex digital means, especially no microcontroller, and is suitable for both DC and AC operating mechanisms, and especially for lower-power electromagnetic operating mechanisms. Since the pickup time and the holding current can assume low values, the control circuit of the present invention also allows the use of AC electromagnetic operating mechanisms that have low-resistance operating coils and which, without using the proposed control circuit, would otherwise only be suitable for AC operation. This allows the manufacture of electromagnetic switching devices to be limited to only AC operating mechanisms, thereby making it possible to reduce the necessary operating coil variants, and thus to markedly reduce costs.

The timer can advantageously be implemented as a simple, integrating or differentiating RC element (also referred to as a "low-pass filter" or "high-pass filter"). The combination with a voltage-limiting device, for example, a Zener diode, results in a limitation of the charging end voltage, thereby considerably reducing the dependence of the charging and discharging processes on the magnitude of the operating voltage.

The controllable voltage source includes a voltage-limiting circuit combined with a threshold circuit and is therefore inexpensive. When using an integrating timer, usually, the charge voltage increasing at the charging capacitor of the RC element is evaluated by the threshold switch as the controlling value for the termination of the pickup phase. When using a differentiating timer, the threshold switch usually evaluates the voltage decreasing at the discharge resistor as a result of the discharging current.

Free-wheeling means, such as a Zener diode, which are placed in parallel with the switching path of the second switching means, provide a fast demagnetization of the operating coil during de-energization, possibly in cooperation with other free-wheeling means.

BRIEF DESCRIPTION OF THE DRAWINGS

Further details and advantages of the present invention will become apparent from the exemplary embodiment described below with reference to the Figures, in which.

DETAILED DESCRIPTION

Figure 1:
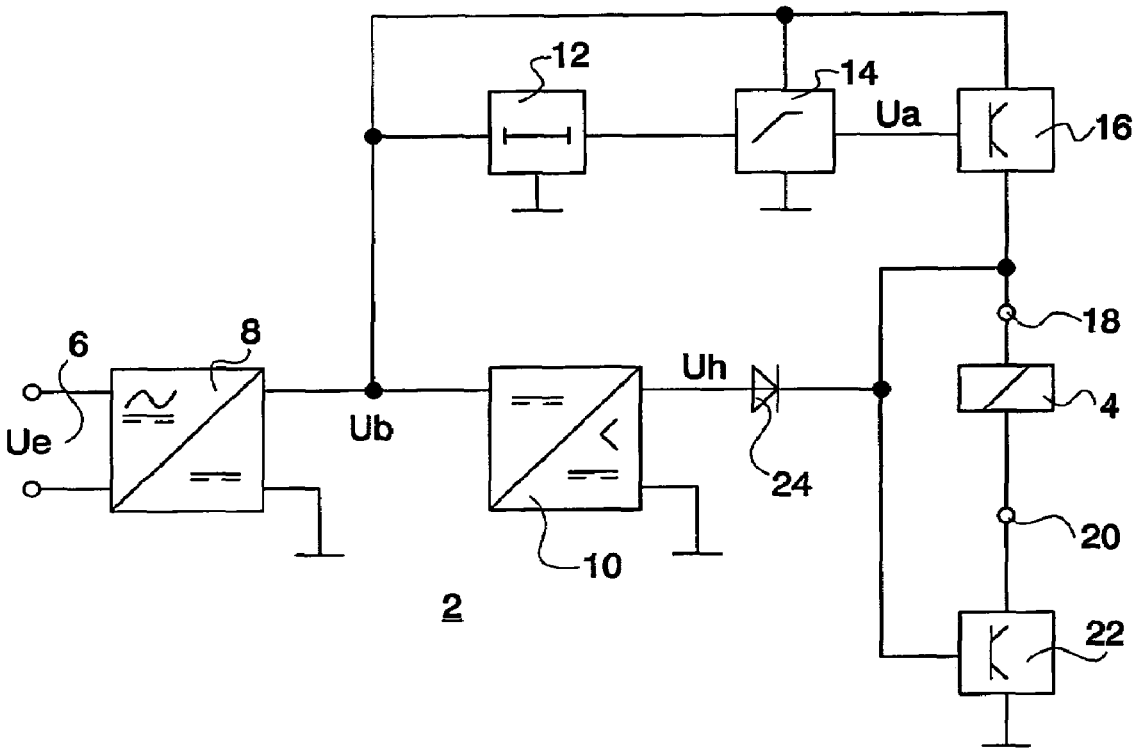
FIG. 1 is a schematic representation of the control circuit according to the present invention.

FIG. 1 shows a control circuit 2 for an operating coil 4 of an electromagnetic operating mechanism (not specifically shown) of an electromagnetic switching device; the control circuit being operated by a control voltage Ue via a control input 6. The control voltage Ue applied can optionally be a DC voltage or an AC voltage. When control voltage Ue is applied, a smoothed operating voltage Ub is present at the output of a rectifier circuit 8; the smoothed operating voltage being used, inter alia, for power supply to control circuit 2 and to operating coil 4. A d.c. voltage converter 10 downstream of rectifier circuit 8 converts operating voltage Ub to a significantly lower smoothed holding voltage Uh. After control voltage Ue has been applied, the rapidly increasing operating voltage Ub triggers a timer 12, the time behavior of which controls the duration of the pickup phase of control circuit 2. Triggered timer 12 activates a voltage source 14 which, when in the activated state, provides at its output a pickup voltage Ua, which is derived from operating voltage Ub. The magnitude of pickup voltage Ua is below that of the minimum permissible operating voltage Ub, and is largely independent of operating voltage Ub within a wide range thereof. Pickup voltage Ua activates first electronic switching means 16 which act as a voltage follower and whose output is connected to first terminal 18 of operating coil 4. Thus, during the pickup phase, first terminal 18 of operating coil 4 is at a potential which, due to a component-related saturation voltage of first switching means 16, differs only slightly from pickup voltage Ua. The output of first switching means 16 is further connected to the control input of second electronic switching means 22 whose switching path leads from second terminal 20 of operating coil 4 to the reference potential of operating voltage Ub. Pickup voltage Ua causes the switching path of second switching means 22 to be enabled. Thus, during the pickup phase, operating coil 4 is supplied with a voltage whose magnitude is slightly reduced by the saturation voltages of the two switching means 16 and 22 as compared to pickup voltage Ua. The output of d.c. voltage converter 10 is connected to the output of first switching means 16 via an isolation diode 24 in the forward direction. During the pickup phase, isolation diode 24 is blocked because the magnitude of pickup voltage Ua is significantly higher than that of holding voltage Uh.

At the end of the pickup phase, the output signal of timer 12 has changed to the point where pickup voltage Ua, which has been present at the output of voltage source 14, is turned off. Because of this, the voltage at the output of first switching means 16 decreases to such a level that holding voltage Uh now reaches first terminal 18 of operating coil 4 and the control input of second switching means 22 via isolation diode 24. Thus, the holding phase has begun. During the holding phase, operating coil 4 is supplied with a voltage whose magnitude is reduced only by the saturation voltages of conducting isolation diode 24 and of the enabled switching path of second switching means 22 as compared to holding voltage Uh.

After control voltage Ue has been removed from input 6 of control circuit 2, operating voltage Ub and holding voltage Uh break down quickly. Thus, the two switching means 16, 22 assume the OFF state, whereupon operating coil 4 is de-energized.

Figure 2:
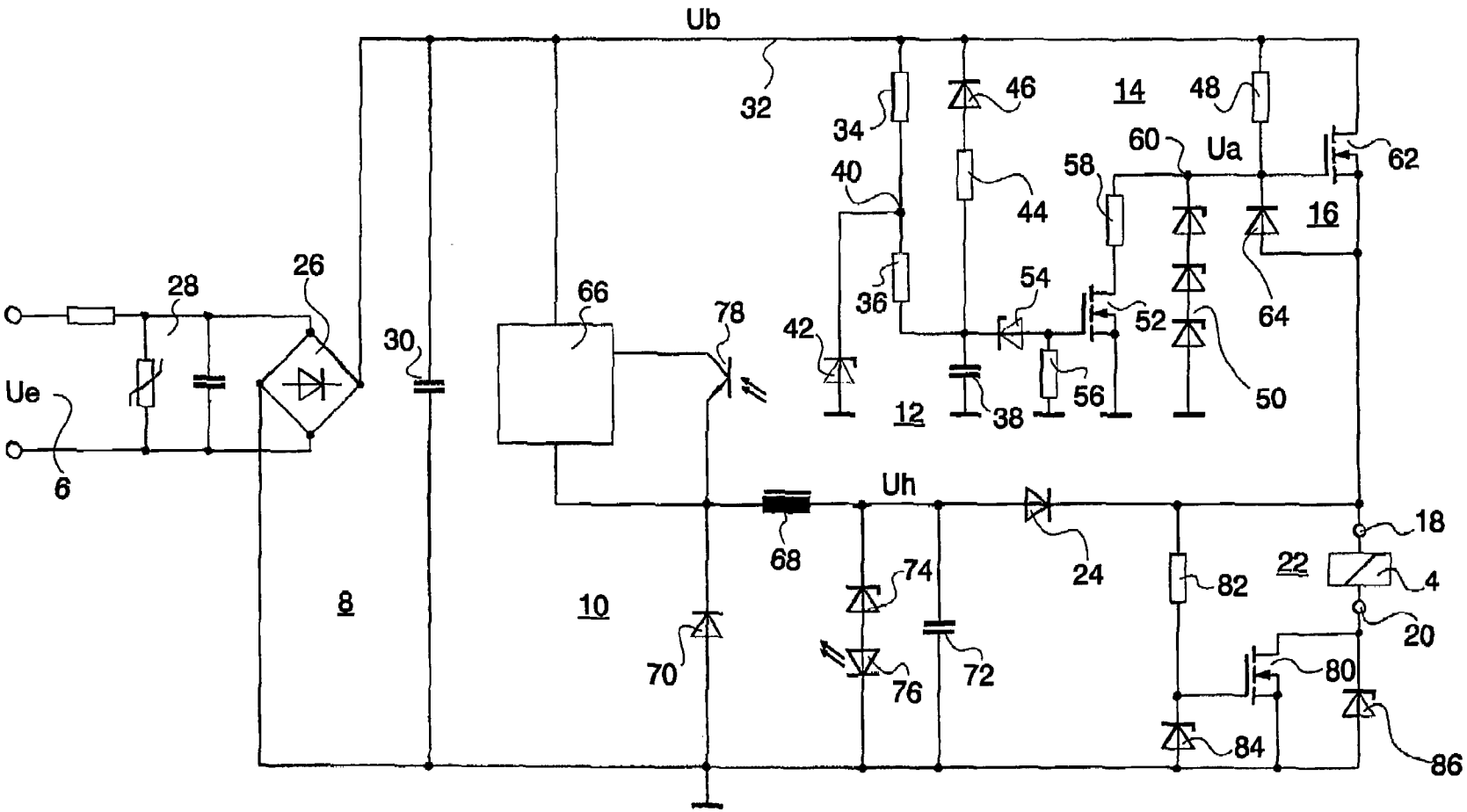
FIG. 2 is a detailed view of an advantageous embodiment of the control circuit of the present invention.

FIG. 2 illustrates a detailed advantageous embodiment of above-described control circuit 2. The reference numerals used in FIG. 1 for the functional groups have been adopted here.

As is usual, rectifier circuit 8 includes a limiter device 28 on the input side, a bridge rectifier 26, and a first smoothing capacitor 30. After control voltage Ue has been applied, operating voltage Ub has ramped up in a short period of time. When driving and operating the control circuit with a control voltage Ue in the form of a DC voltage, bridge rectifier 26 serves as a reverse polarity protection.

Timer 12 is designed as an integrating RC element. Starting at a supply line 32 carrying operating voltage Ub, a charging current flows through the series circuit of two charging resistors 34 and 36 to a charging capacitor 38 after operating voltage Ub has appeared. The voltage at a first junction point 40 of the two charging resistors 34, 36 is limited by a voltage-limiting device in the form of a Zener diode 42. Thus, the time behavior of timer 12 is largely independent of the magnitude of operating voltage Ub. The time behavior is mainly determined by the design of the RC element formed by charging resistor 36 and charging capacitor 38. After control voltage Ue has been removed, charging capacitor 38 discharges through a discharge resistor 44 and a discharge diode 46 into the now de-energized supply line 32. Thus, timer 12 is ready to be turned on again.

Controllable voltage source 14 is includes a threshold circuit evaluating the charge voltage of charging capacitor 38 and a voltage-limiting circuit coupled to the output of the threshold circuit. The voltage-limiting circuit is formed by a series circuit of a first series resistor 48 and a series of Zener diodes 50, and is placed between supply line 32 and the reference potential. The threshold circuit features a third transistor 52 in common source configuration. Charging capacitor 38 is connected via a second Zener diode 54 to the gate terminal of third transistor 52. A bleed resistor 56 placed between the gate terminal of third transistor 52 and the reference potential is used to protect the gate electrode. The drain terminal of third transistor 52 is connected via a load resistor 58 to a second junction point 60, which is common to first series resistor 48 and the series of Zener diodes 50. As long as the voltage across charging capacitor 38 has not yet exceeded the sum of the Zener voltage of second Zener diode 54 and the switching threshold of the gate voltage of third transistor 52, third transistor 52 is in the OFF or non-conducting state. In this case, pickup voltage Ua is present at second junction point 60; the pickup voltage being derived from the sum of the Zener voltages of the series of Zener diodes 50. When, toward the end of the pickup phase, the voltage at charging capacitor 38 exceeds the sum of the Zener voltage of second Zener diode 54 and the switching threshold of the gate voltage of third transistor 52, the third transistor goes to the ON or conducting state. In this case, the voltage at second junction point 60 falls far below pickup voltage Ua. The resistance value of series resistor 48 is selected to be high compared to that of load resistor 58.

First switching means 16 are formed by a first transistor 62 in source follower configuration with a first protective diode 64 to protect first transistor 62 from negative voltage spikes between the gate and source terminals thereof. The output of first switching means 16, which is connected to first terminal 18 of operating coil 4, is identical to the source terminal of first transistor 62 and, during the pickup phase, supplies pickup voltage Ua, which is reduced by the gate-source voltage of first transistor 62. Due to the potential drop at second junction point 60 toward the end of the pickup phase, first transistor 62 is turned off.

D.c. voltage converter 10 is formed by a converter circuit 66 connected at the input to supply line 32, by smoothing means on the output side, as well as detecting means for measuring and controlling the output holding voltage Uh. As is usual, the smoothing means are formed by a smoothing choke 68 and a feedback diode 70 at the output of converter circuit 66 as well as a second smoothing capacitor 72 connected downstream of smoothing choke 68. When control voltage Ue is applied, holding voltage Uh is present across second smoothing capacitor 72. The detecting means are formed by a series circuit which is composed of a third Zener diode 74 and a photodiode 76 and is placed in parallel with second smoothing capacitor 72, and by a phototransistor 78 optically coupled to photodiode 76. Phototransistor 78 is connected at its emitter terminal to the output of converter circuit 66 and at its collector terminal to a control input of the converter circuit. Thus, holding voltage Uh is determined by the sum of the Zener voltage of third Zener diode 74 and the conducting-state voltage of photodiode 76. After control voltage Ue has been applied, holding voltage Uh has ramped up in about 30 ms. After control voltage Ue has been removed, second smoothing capacitor 72 discharges in a short period of time through the current path formed by isolation diode 24, operating coil 4, and the switching path of second switching means 22.

Second switching means 22 include a second transistor 80 in common source configuration. This second transistor is connected to first terminal 18 of operating coil 4 through a second series resistor 82, and to a second protective diode 84. Second protective diode 84 is designed as a Zener diode and protects the gate terminal of second transistor 80 from excessive voltages, especially during the pickup phase. The drain terminal of second transistor 80 is connected to second terminal 20 of operating coil 4. During the pickup phase, second transistor 80 is switched to the ON or conducting state due to pickup voltage Ua from the output of first switching means 16, and during the holding phase due to holding current Uh via conducting isolation diode 24, so that operating coil 4 is continuously energized during both phases. When control voltage Ue is absent or removed, second transistor 80 is in the OFF or non-conducting state, thus preventing operating coil 4 from being continuously energized. A free-wheeling means 86, which in the example is a Zener diode, is placed in parallel with the switching path of second transistor 80. During both the pickup phase and the holding phase, free-wheeling means 86 is short-circuited by the enabled switching path of second transistor 80 and, therefore, has no effect. However, when second transistor 80 is turned off, operating coil 4 discharges in a short period of time through the current path formed by free-wheeling means 86, feedback diode 70, smoothing choke 68, and isolation diode 24. The relatively high free-wheeling voltage mainly caused by the Zener voltage of free-wheeling means 86 causes the magnetic energy stored in operating coil 4 to be quickly removed, thereby causing the electromagnetic operating mechanism to be quickly turned off.

The present invention is not limited to the embodiment described above. For example, the present invention can also be implemented using a differentiating timer, such as is described, for example, in German Publication DE 92 16 041 U1 mentioned at the outset.

What is claimed is:

1. A control circuit for an electromagnetic operating mechanism, the control circuit comprising:

a timer;

a first electronic switching device including a voltage follower and including a first output connected in series with an operating coil of the electromagnetic operating mechanism, the first electronic switching device being configured to activate for a duration of a pickup phase of the electromagnetic operating mechanism after a control voltage has been applied via the timer;

a second electronic switching device including a switching path connected in series with the operating coil, the second electronic switching device being turned on while the control voltage is present;

a rectifier circuit connected to a control input, the rectifier circuit including a second output and being configured to supply a smoothed operating voltage at the second output;

a step-down DC voltage converter connected downstream of the rectifier circuit, the step-down DC voltage converter including a third output and being configured to supply a smoothed holding voltage at the third output; and a voltage source controllable by the timer and configured to activate the first electronic switching device by a pickup voltage;

wherein:

the timer is activatable by a ramping up of the operating voltage;

the operating coil and the switching path of the second electronic switching device form a series circuit connected to the first output;

the series circuit and the first electronic switching device are suppliable with the operating voltage; and the third output, the first output, and a control input of the second electronic switching device are interconnected, the third output being interconnected via a forward biased isolation diode.

2. The control circuit as recited in claim 1 wherein the electromagnetic switching device includes an operating mechanism.

3. The control circuit as recited in claim 1 wherein the timer includes an integrating RC element.

4. The control circuit as recited in claim 1 wherein the timer includes a differentiating RC element.

5. The control circuit as recited in claim 3 wherein the RC element is combined with a voltage-limiting device.

6. The control circuit as recited in claim 4 wherein the RC element is combined with a voltage-limiting device.

7. The control circuit as recited in claim 1 wherein the voltage source includes a voltage-limiting circuit and a threshold circuit having an input side, the voltage-limiting circuit being supplied with the operating voltage and having a fourth output operatively connected to a switching path of a the threshold circuit, the input side of the threshold circuit being connected to the timer.

8. The control circuit as recited in claim 1 further comprising a free-wheeling device connected in parallel with the switching path of the second electronic switching device.

9. The control circuit as recited in claim 3 wherein the voltage source includes a voltage-limiting circuit and a threshold circuit having an input side, the voltage-limiting circuit being supplied with the operating voltage and having a fourth output operatively connected to a switching path of a the threshold circuit, the input side of the threshold circuit being connected to the timer.

10. The control circuit as recited in claim 4 wherein the voltage source includes a voltage-limiting circuit and a threshold circuit having an input side, the voltage-limiting circuit being supplied with the operating voltage and having a fourth output operatively connected to a switching path of the threshold circuit, the input side of the threshold circuit being connected to the timer.

11. The control circuit as recited in claim 5 wherein the voltage source includes a voltage-limiting circuit and a threshold circuit having an input side, the voltage-limiting circuit being supplied with the operating voltage and having a fourth output operatively connected to a switching path of the threshold circuit, the input side of the threshold circuit being connected to the timer.

12. The control circuit as recited in claim 3 further comprising a free-wheeling device connected in parallel with the switching path of the second electronic switching device.

13. The control circuit as recited in claim 4 further comprising a free-wheeling device connected in parallel with the switching path of the second electronic switching device.

14. The control circuit as recited in claim 5 further comprising a free-wheeling device connected in parallel with the switching path of the second electronic switching device.

* * * * *